United States Patent [19]

Furrer

[11] 4,094,133

[45] June 13, 1978

[54] METHOD AND APPARATUS FOR CONTROLLING AN OPEN-END SPINNING MACHINE

[75] Inventor: Edwin Furrer, Winterthur, Switzerland

[73] Assignee: Rieter Machine Works Limited, Winterthur, Switzerland

[21] Appl. No.: 700,061

[22] Filed: Jun. 25, 1976

[30] Foreign Application Priority Data

Jul. 16, 1975 Switzerland ..... 9298/75

[51] Int. Cl.[2] ..... D01H 1/32

[52] U.S. Cl. ..... 57/34 R; 57/58.89; 57/100; 57/156; 361/194

[58] Field of Search ..... 57/34 R, 58.89, 58.95, 57/78, 100, 156; 317/154; 361/194

[56] References Cited

U.S. PATENT DOCUMENTS

| | | | |
|---|---|---|---|
| 3,678,673 | 7/1972 | Prochazka et al. | 57/34 R X |
| 3,704,579 | 12/1972 | Tooka et al. | 57/58.89 X |

*Primary Examiner*—Richard C. Queisser
*Assistant Examiner*—Charles Gorenstein
*Attorney, Agent, or Firm*—Werner W. Kleeman

[57] ABSTRACT

A method of, and apparatus for, controlling the startup, the normal operation and the stopping of all spinning positions of an open-end spinning machine provided with an electronic control unit supplied with power via a supply line. Control circuits extend from the electronic control unit to devices which influence the course of the spinning position. In the event of failure of the electronic control unit the normal operation is maintained.

8 Claims, 1 Drawing Figure

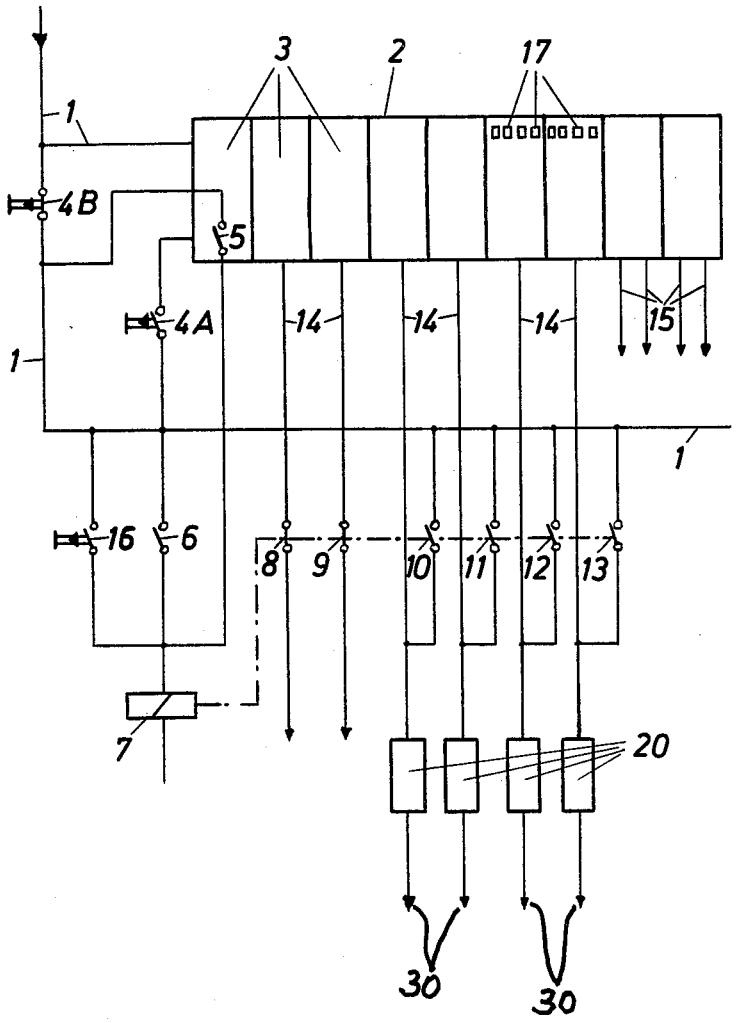
3
2
17
1
4B
5
4A
14
14
14
15
1
1
16
6
8
9
10
11
12
13
7
20
30
30

METHOD AND APPARATUS FOR CONTROLLING AN OPEN-END SPINNING MACHINE

BACKGROUND OF THE INVENTION

The present invention relates to a new and improved method of controlling the start-up, the normal operation and the stopping of all spinning positions of an open-end spinning machine, and this invention also pertains to novel apparatus for implementing the aforesaid method.

During the normal operation of an open-end spinning machine the driven elements of each spinning position are driven by shafts and belts which extend over the entire machine length. With this arrangement the driven elements are in a speed ratio relative to one another which is constant and can be chosen as required by the spinning process. Thus, it is only necessary that a number of electric motors be kept operating at a certain constant speed, and there is not required any electrical function control. Operation of the motors is controlled by conventional switching relays. Such operation requires very low switching frequencies and results in high performance reliability.

In the case of a relay-controlled open-end spinning machine without automatic control of the start-up process, the yarn must be again manually re-spun or pieced-up after an interruption of the operation at each spinning position, since the spinning operation is only possible at speeds exceeding a minimum rotational speed of the rotor. Hence, for reasons of economy this starting spinning or piecing-up operation undertaken at modern machines is carried out automatically and simultaneously at the numerous spinning positions of the machine within a very short period of time. However, if the automatic piecing operation is to be made possible, then, there is required stopping of the machine in a strictly determined functional sequence, since re-piecing is only possible under certain conditions governed by the spinning process. The automatic start-up operation therefore also requires an automatic stopping of the machine.

Automatic starting and stopping of the machine is carried out by controlling different motors, clutches and brakes according to so-called start-stop programs. On high-speed modern day machines, such complicated control functions only can be performed by an electronic control unit. These electronic control units additionally can perform numerous auxiliary functions such as, for instance, counting the quantity of produced yarn, monitoring the vacuum in the rotor and monitoring the electrical voltage. But, of course, such an electronic control unit also controls the most frequently prevailing normal operation.

While without doubt the introduction of electronics for machine control applications has yielded many advantages, nonetheless a certain disadvantage exists. Although the theoretical life span of electronic components is several years, nonetheless they are considerably more susceptible to disturbances under the environmental conditions which prevail in practical use than, for instance, relay switches of very low switching frequencies. Thus, factors such as vibrations, humidity, electrical disturbances, material defects, undue handling and other reasons can cause unexpected premature failure of such components. Should such a disturbance occur, then usually the control unit automatically stops functioning and at the same time the machine is automatically stopped. Even if such disturbances rarely occur, nonetheless the entire machine stands idle throughout the repair time. Due to the lack of knowledge about and the usual dislike of the operating personnel against electronics, it is oftentimes the case that the damage cannot be repaired by using the mill's own resources, resulting in economically unbearable machine downtime periods.

SUMMARY OF THE INVENTION

Hence, it is a primary object of the present invention to devise a new and improved method of, and apparatus for, controlling an open-end spinning machine in a manner not associated with the aforementioned drawbacks and limitations of the prior art proposals.

Another and more specific object of the present invention aims at avoiding the disadvantages which are inherent in electronic devices and to further eliminate production losses if the electronic control unit fails.

Now in order to implement these and still further objects of the invention, which will become more readily apparent as the description proceeds, the method aspects of the invention for controlling the start-up, the normal operation and the stopping of all spinning positions of an open-end spinning machine equipped with an electronic control unit supplied via a supply line, and from which control unit there extend control circuits to devices controlling the spinning positions, are manifested by the features that in the event of failure of the electronic control unit there is maintained the normal operation of the spinning positions.

As mentioned above, the invention is also concerned with apparatus for the performance of the method, which apparatus is manifested by the features that there is provided a circuit containing a relay having a self-holding contact connected via a switch with the control unit. The relay is operatively connected with contacts for opening given control circuits and contacts connecting other given control circuits to the power supply line.

BRIEF DESCRIPTION OF THE DRAWINGS

The invention will be better understood and objects other than those set forth above, will become apparent when consideraion is given to the following detailed description thereof. Such description makes reference to the annexed drawing wherein the schematic circuit diagram illustrates an exemplary embodiment of the invention in the idling position.

DETAILED DESCRIPTION OF THE INVENTION

Describing FIGURE an exemplary embodiment of apparatus for controlling an open-end spinning machine as contemplated by the invention, there will be seen from the circuit diagram of the single Figure that a power supply line 1 furnishes power, typically direct-current to a control unit 2. This control unit 2 embodies insertable electronic modules 3 at which there are stored the individual control functions for starting-up, normal operation and stopping of the machine. A switch 4A is used for switching-on the open-end spinning machine having the spinning positions generally indicated by reference character 30 and a switch 4B serves for switching-off such machine. By means of a switch 5 there can be switched-on a relay 7 provided with a self-holding contact 6. This relay 7 is used to activate the contacts 8, 9, 10, 11, 12 and 13, which in the case of the contacts 8, 9 connect the associated control lines or circuits 14 and in the case of the contacts 10, 11, 12, 13 provide a bridge or bypass connection with the supply line 1. The control lines or circuits 14 extend to devices 20 which, during the start-up, the normal spinning operation and the stopping of the machine drive and/or control such machine, i.e. influence the operation thereof. Auxiliary circuits 15 extend to devices which perform secondary functions such as, for instance, counting the quantity of yarn which has been produced, monitoring the vacuum in the rotors or the electrical voltage. In the circuit diagram which has been illustrated, only a few of the circuits or lines 14 and 15 have been shown. In reality, according to the number of control units which are needed a correspondingly greater number of control circuits and auxiliary circuits are provided. The relay 7 can be manually operated by means of the hand-switch 16. The electronic modules 3 which can be inserted into the control unit 2 and which can be exchanged are provided with operating and display elements 17 by means of which it is possible to simulatingly test the control functions of each electronic module 3 without the module having to be connected to the control unit 2.

The spinning process at all of the spinning positions 30 of the open-end spinning machine is controlled by means of the control unit 2 during the start-up, the stopping and during normal operation of the open-end spinning machine. During start-up and during the stopping process the complicated sequence of operational steps stored in the control unit 2 are carried out, whereas during the normal operation there is only executed the monitoring function.

During the start-up and stopping operations the control unit 2 maintains the switch 5 in an open condition such that the relay 7 does not have current supplied thereto and further maintains the contacts 8 and 9 closed and the contacts 10 to 13 open. Hence, the control unit 2 through the agency of the circuits 14 and by means of the auxiliary circuits 15 can activate all of the control functions. The contacts 8 and 9 are in circuit, for instance, with brakes and the contacts 10 to 13 with motors, clutches and electromagnets. Upon completion of the start-up process the control unit 2 closes the switch 5 such that the relay 7 and its self-holding contact 6 are closed. Relay 7 now causes the contacts 8 and 9 to open and the contacts 10 to 13 to close. Hence, the normal operation remains unchanged since the contacts 8 and 9 which are in circuit with the brakes are not needed and the other circuits 14 are additionally bridged by the contacts 10 to 13 with the supply line 1.

Now if the situation should arise where an electronic module 3 fails due to a defect and the control unit 2 immediately switches-off and the switch 5 is opened, the control circuits or lines 14 and the auxiliary circuits 15 no longer would carry any current. However, the relay 7 remains closed owing to the action of its self-holding contact 6. The contacts 10 to 13 thus also remain closed so that the control circuits 14 continue to receive current from the power supply line 1 and thus the open-end spinning machine continues its normal operating process. In this way the spinning process can be continued at all spinning positions 30 during any desired time duration. Since the auxiliary circuits 15 are no longer supplied with current by the control unit 2 the secondary functions no longer can be controlled but this is of no consequence for the continuation of the spinning process. If the open-end spinning machine must be stopped for any reason then this can be carried out in a normal manner by means of the manually-operated switch 4B. By means of the manually-operated switch or key 16 it is possible to again restart the machine without the electronic module 3 having to be connected. In this way there can be realized a simple auxiliary operation without a start-stop program.

While the normal operation continues it is possible to check all of the electronic modules 3 with respect to their function by using the operating and display elements 17. As soon as the defective module 3 has been located it is replaced by a spare module, whereupon the control unit 2 is again ready for use and again can perform all of the control functions.

When employing the inventive method and the apparatus heretofore described the normal spinning process can be maintained at all spinning positions of the machine nothwithstanding failure of the electronic control unit. Moreover, such failure can be repaired within a relatively short period of time owing to the exchangeability of the plug-in electronic modules.

While there are shown and described present preferred embodiments of the invention, it is to be distinctly understood that the invention is not limited thereto, but may be otherwise variously embodied and practiced within the scope of the following claims. Accordingly,

What is claimed is:

1. In a method of controlling the start-up, the normal spinning operation and the stopping of all spinning positions of an open-end spinning machine comprising an electronic control unit supplied with power from a power source via a power line, and control circuits extending from the electronic control unit to devices which influence the operation of the spinning positions, the improvement comprising maintaining the normal spinning operation of the spinning positions of the open-end spinning machine in case of failure of the electronic control unit by continuing to supply power for the normal spinning operation from said power source to at least some of said control circuits.

2. The method as defined in claim 1, further including the step of providing a shunt connection between the supply line and at least some of the control circuits extending between the electronic control unit and the devices influencing the operation of the spinning positions.

3. The method as defined in claim 1, wherein the normal spinning operation of the spinning positions is maintained during repair of the failure of the electronic control unit.

4. An apparatus for controlling the start-up, the normal operation and the stopping of all spinning positions of an open-end spinning machine comprising an electronic control unit, a power supply line for delivering power to the electronic control unit, control circuits extending between the electronic control unit and the spinning positions for influencing the operation of such spinning positions, a relay provided with a self-holding contact, a switch connecting the relay with the electronic control unit, first contact means and second contact means, said relay being operatively connected with the first contact means for opening at least some of said control circuits and with said second contact means for connecting at least some of said control circuits with the power supply line.

5. The apparatus as defined in claim 4, further including a manually-operated switch for connecting the relay with the supply line.

6. The apparatus as defined in claim 4, wherein said electronic control unit comprises insertable and exchangeable electronic modules.

7. The apparatus as defined in claim 6, wherein the electronic modules include operating and display elements for the simulating testing of such electronic modules without being connected with the electronic control unit.

8. An apparatus for controlling the start-up, the normal operation and the stopping of all spinning positions of an open-end spinning machine comprising an electronic control unit, a power supply line for delivering power to the electronic control unit, control circuits extending between the electronic control unit and the spinning positions for influencing the operation of such spinning positions, a relay provided with a self-holding contact, at least one first contact connected with an associated one of said control circuits, at least one second contact connected with another one of said associated control circuits, said relay being operatively connected with the first contact for opening its associated control circuit and with said second contact for connecting its associated control circuit with the power supply line.

* * * * *

UNITED STATES PATENT AND TRADEMARK OFFICE

CERTIFICATE OF CORRECTION

PATENT NO. : 4,094,133

DATED : June 13, 1978

INVENTOR(S) : EDWIN FURRER

It is certified that error appears in the above-identified patent and that said Letters Patent are hereby corrected as shown below:

Column 5, line 6, read "simulating" as --simulation--

Signed and Sealed this

*Fifth* Day of *December 1978*

[SEAL]

*Attest:*

RUTH C. MASON
*Attesting Officer*

DONALD W. BANNER
*Commissioner of Patents and Trademarks*